US005454418A

United States Patent [19]

Brophy et al.

[11] Patent Number: 5,454,418

[45] Date of Patent: Oct. 3, 1995

[54] MEANS FOR LIFTING HEAT TRANSFER ELEMENT BASKETS

[75] Inventors: Mark E. Brophy, Wellsville, N.Y.; Steven M. Gustin, Eldred, Pa.

[73] Assignee: ABB Air Preheater, Inc., Wellsville, N.Y.

[21] Appl. No.: 278,166

[22] Filed: Jul. 21, 1994

[51] Int. Cl.[6] ..... F23L 15/02

[52] U.S. Cl. ..... 165/8; 165/76

[58] Field of Search ..... 165/6, 8, 76; 294/81.5, 294/81.56

[56] References Cited

U.S. PATENT DOCUMENTS

| | | | |
|---|---|---|---|
| 4,209,060 | 6/1980 | Wiking et al. | 165/8 |
| 4,552,204 | 11/1985 | Bellows | 165/10 |
| 4,627,485 | 12/1986 | Osborn | 165/8 |
| 4,739,822 | 4/1988 | Mergler | 165/10 |
| 4,773,145 | 9/1988 | Baker et al. | 29/157.3 R |
| 5,303,966 | 4/1994 | Robinson | 294/81.5 |

*Primary Examiner*—John Rivell
*Assistant Examiner*—Christopher Atkinson
*Attorney, Agent, or Firm*—Chilton, Alix & Van Kirk

[57] ABSTRACT

A heat transfer element basket assembly for a rotary regenerative heat exchanger having a splitter plate or stiffening member mounted between the heat transfer plates at a position intermediate between the inner and outer ends of the basket. The stiffening member includes elongated slots adjacent the top surface which accommodate lifting lugs. Elongated slots and lifting lugs also may be included adjacent the bottom surface of the basket. These lugs slide up and down within the elongated slots to an extended position partially above the surface of the basket when in the lifting mode and to a retracted position fully below the surface when not in use. Since the lugs are retracted when the basket has been placed in the rotor, they will not interfere with the vertically adjacent baskets. This means that the baskets have a low profile and can be tightly packed in the rotor.

3 Claims, 3 Drawing Sheets

(u Microfiche)

MEANS FOR LIFTING HEAT TRANSFER ELEMENT BASKETS

BACKGROUND OF THE INVENTION

The present invention relates to heat transfer element baskets and, more specifically, to improve means for lifting the baskets into and out of an assembly. The present invention has particular application in heat transfer apparatus of the rotary regenerative type.

One type of heat exchange apparatus commonly used for gas-to-gas heat exchange in the process industry and for gas-to-air heat exchange on utility stream generators is the well-known rotary regenerative heat exchanger or air preheater. A rotary regenerative heat exchanger has a cylindrical rotor divided into compartments in which are disposed a mass of heat transfer elements which, as the rotor turns, are alternately exposed to a stream of hot gas and then upon rotation to a stream of cool gas or air to be heated. The heat absorbent mass typically comprises a plurality of heat transfer element basket assemblies which are mounted in sector shaped compartments in the rotor frame. Each of the heat transfer element basket assemblies houses a large number of heat transfer plates which absorb heat from the hot gas and then transfer that heat to the cool gas or air.

As described in U.S. Pat. No. 4,739,822, the heat transfer element basket assemblies may include a stiffening member which is sometimes referred to as a splitter plate. This plate is disposed parallel to the heat transfer plates and located about midway between the inner and outer ends of the basket. As indicated in that prior patent, the stiffening member ties together the structural members of the basket and increases the structural integrity of the frame of the basket assembly. As also indicated in that prior patent, the stiffening member may include lifting holes along the upper region or edge to provide for insertion of lifting hooks. These facilitate the initial placement of the baskets into the rotor frame during field assembly and removal of the baskets for replacement. Also, the baskets adjacent to the cold end of the rotor can undergo severe corrosive duty and these particular baskets are often removed and reversed in position and operated for an additional period of time in that orientation before requiring replacement.

Merely placing holes in a stiffener plate to accommodate a lifting hook has several disadvantages. First of all, the hook can become disengaged from the hole during the lifting operation creating obvious problems. Furthermore, if the stiffening plate extends up above (and below) the heat transfer plates such that the hole is accessible, an undesirable empty or dead space is created within the heat exchanger in the axial space between the stacked baskets which contains no heat exchange surface. This results in an increase in the overall height of the heat exchanger. For that reason, so called low profile baskets are normally used which do not have the extended stiffener plate and corresponding basket framework. In order to have accessible lifting holes, extended tabs are often provided which contain the lifting holes. Once they are lifted into place in the assembly, the tabs are cut off to fit the baskets into the assembly. However, this requires additional time and cost in the field erection process and the lifting holes are no longer available for disassembly.

SUMMARY OF THE INVENTION

The present invention involves a heat transfer element basket having improved means to facilitate lifting which provide for a safe, positive engagement of the lifting means and does not require fixed extensions out from the periphery of the basket envelope. More specifically, lifting means are provided which are extendable out from the basket during the lifting operation and are then retracted back into the basket inside of the basket envelope.

DESCRIPTION OF THE PREFERRED EMBODIMENT

Figure 1:
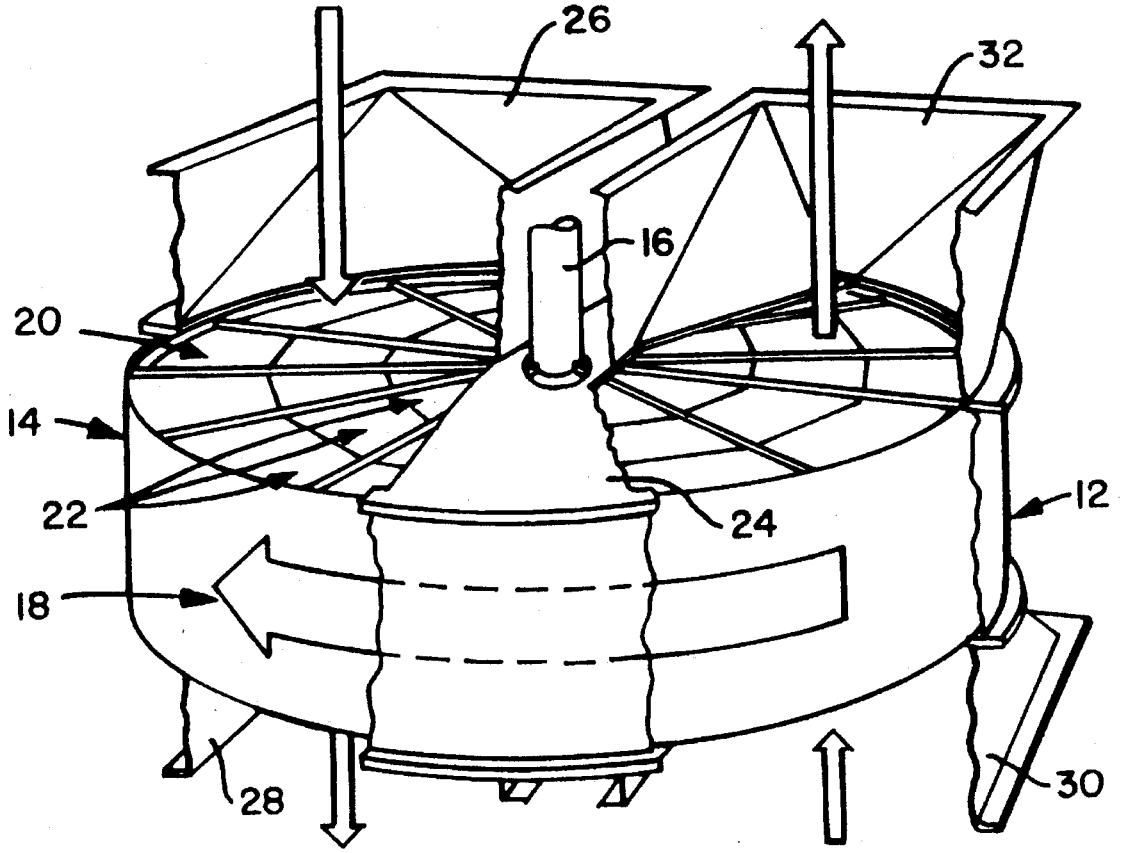
FIG. 1 is a general perspective view of a typical rotary regenerative heat exchanger with the casing partially broken away with which the present invention can be employed.

FIG. 1 of the drawings is a partially cut-away perspective view of a typical rotary regenerative heat exchanger showing a housing 12 in which the rotor 14 is mounted on the drive shaft or post 16 for the rotation as indicated by the arrow 18. The rotor is composed of a plurality of sectors 20 with each sector containing a number of heat transfer element baskets 22. The baskets 22 contain the heat transfer plates. The housing is divided by means of the sector plate 24 into a hot gas side and a cold gas side. The hot gases enter the heat exchanger 12 through the gas inlet duct 26, flow through the rotor where heat is transferred to the heat exchange plates and then exits through the gas outlet duct 28. The countercurrent flowing gas to be heated, which will be described as being air, enters through the rotor where it picks up heat from the heat transfer plates and then exits through air outlet duct 32. The present invention relates to the lifting means for loading the baskets 22 into the rotor 14.

Figure 2:
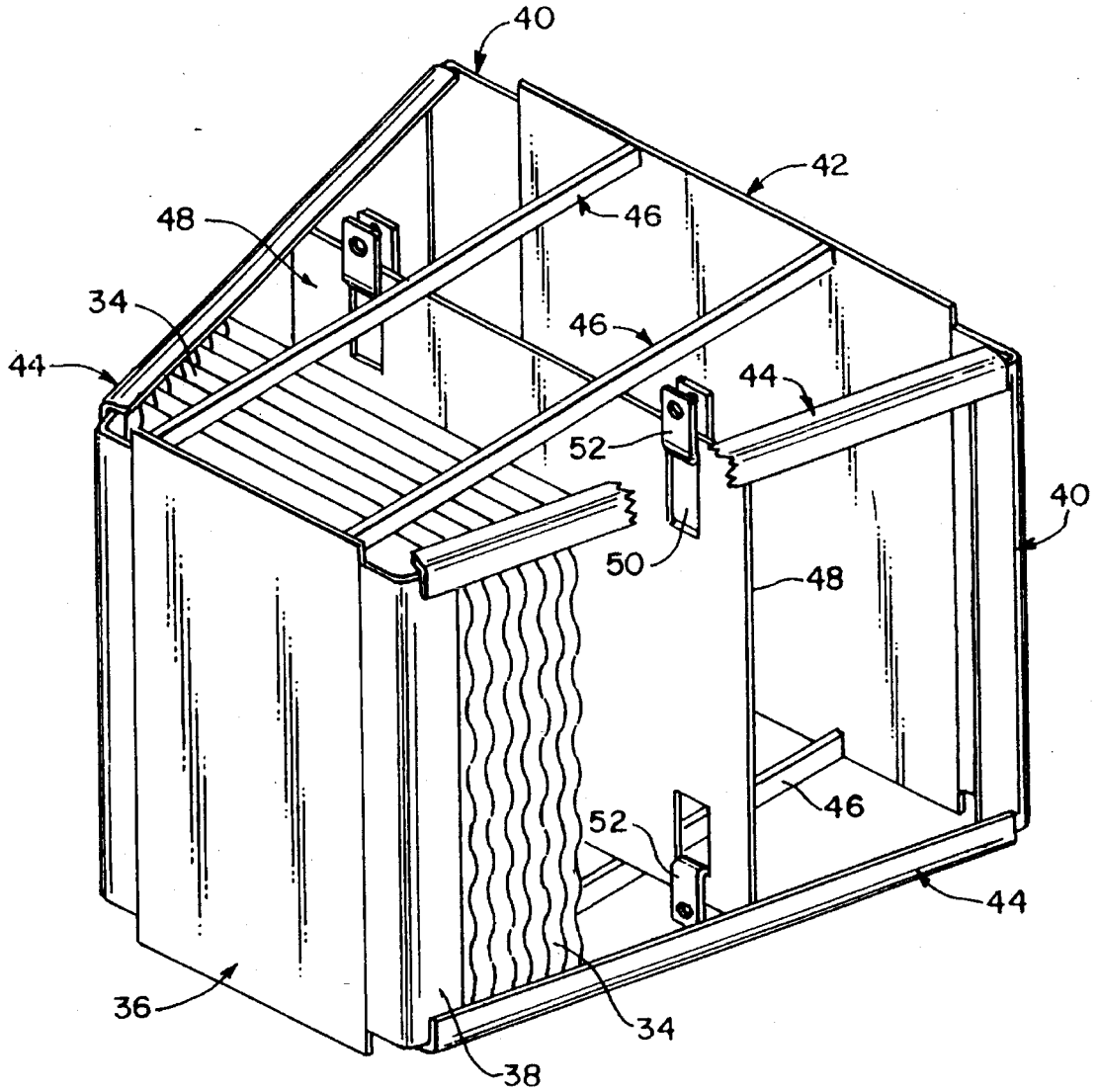
FIG. 2 is a perspective view of a heat transfer element basket with a portion of the heat transfer plates removed for clarity and illustrating the lifting means of the present invention.

FIG. 2 illustrates a single heat transfer element basket 22 showing a portion of the heat transfer plates 34. Of course, the basket would be filled with these heat transfer plates but the remainder have been omitted for clarity. The frame of the basket 22 comprises a nose piece or inner end 36 which is bent outwardly at the sides to form the corners 38. The outer end of the basket is defined by the outboard corner angles 40 which are attached by welding to the outer end piece 42. The inner and outer ends are connected by the welded side angles 44 and the upper and lower tie bars 46. These members form the basic framework of the basket. The stiffening member or splitter plate 48 is located approximately midway between the inner and outer ends and is welded to the side angles 44 and the tie bars 46. Specifically, the stiffening member should be located approximately on a plane through the center of gravity of the basket since this member is to be used to lift the basket.

Figure 3:
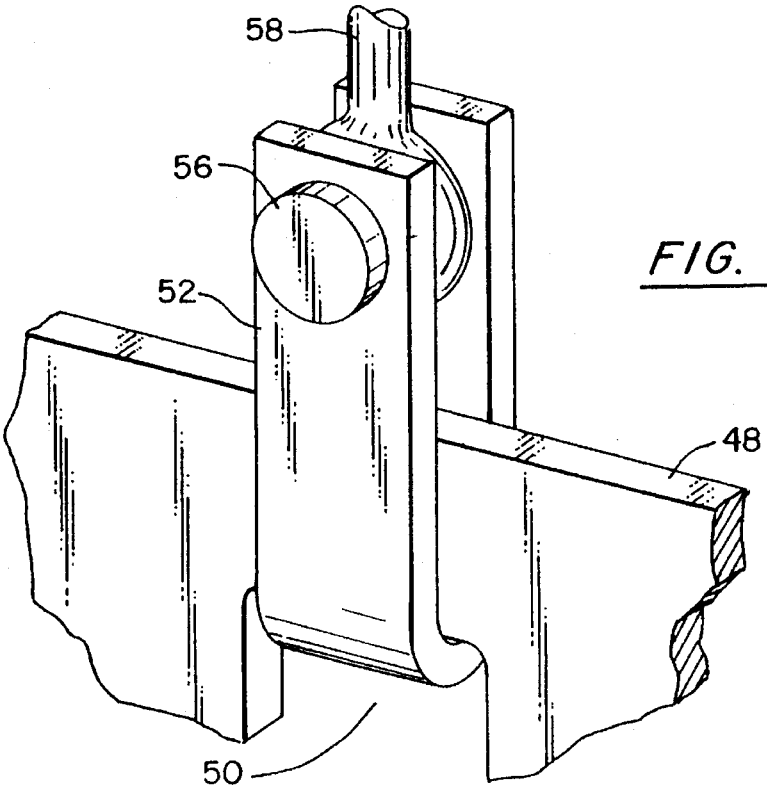
FIG. 3 is a detailed view of the lifting means.

Formed into the stiffening member 48 are the elongated lifting slots 50 which contain the lifting lugs 52. These lifting lugs 52 are U-shaped members containing a hole 54 through which a clevis pin 56 is inserted to attach a cable 58 or other lifting device to the basket as shown in FIG. 3.

Figure 4:
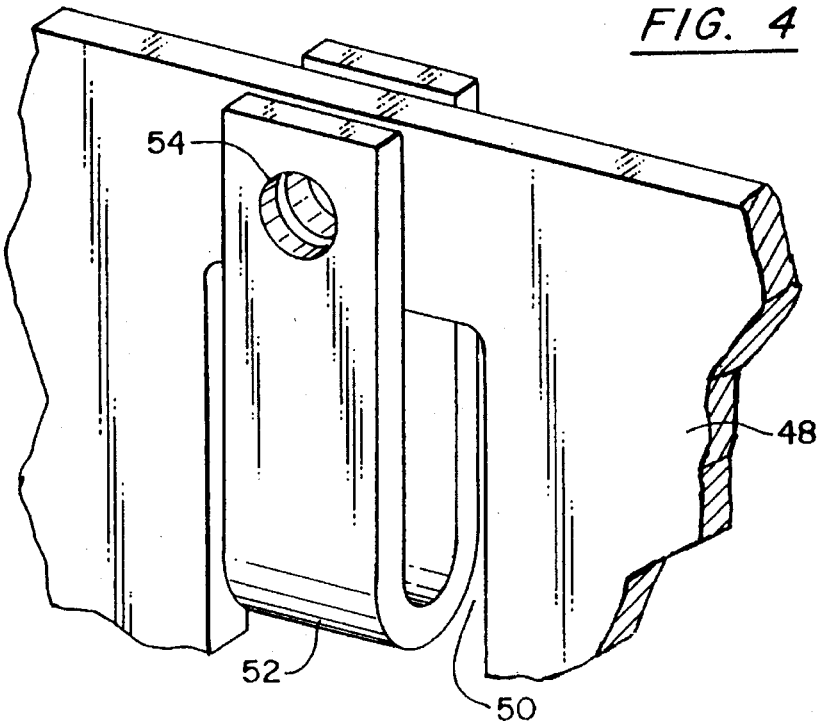
FIG. 4 is a view similar to FIG. 3 showing the lifting lug in the retracted position.

As can be seen, the lifting slots 50 are elongated in the vertical direction. This permits the lifting lugs 52 to move up and down within the slots. The slot and the lug are both dimensioned such that the lug protrudes upwardly out from the surface of the basket into an extended position when in the lifting mode and such that the lug can be retracted down below the surface of the basket once the basket has been installed. FIG. 3 is a detailed view of the lifting slot 50 with the lifting lug 52 in the raised position and illustrating a lifting cable 58 and clevis pin 56 in position. When the basket has been installed, the clevis pin is removed and the lifting lug is retracted down into the basket as shown in FIG. 4. This prevents the lug from interfering with the basket layer to be installed above. Preferably, the lifting lugs fit tightly around the stiffening member 48 so that there is an interference fit which will prevent the lifting lug from moving particularly during rotation of the rotor. The tight fitting lifting lug is pounded down to its retracted position and may be pulled up for future use. The lifting slots and lifting lugs are located adjacent the top surface and can be located adjacent the bottom surface to facilitate reversing the orientation of the basket.

We claim:

1. A heat transfer element basket assembly for a rotary regenerative heat exchanger comprising:

a. a basket framework including first and second end plates disposed at inner and outer ends of said basket and having top and bottom surfaces, b. a plurality of heat exchange plates juxtaposed in a stacked array between said first and second end plates, and c. a stiffening member mounted within said framework and located within said stacked array of heat exchange plates intermediate said first and second end plates, said stiffening member having top and bottom edges adjacent top and bottom surfaces of said framework and including:

i. a pair of spaced apart elongated slots adjacent said top edge, and ii. a lifting lug mounted in each of said slots, said lifting lugs adapted to be attached to a lifting device and being slidable in said elongated slots between an extended position partially protruding above the top surface of said basket framework and a retracted position fully below said top surface.

2. A heat transfer element basket assembly as recited in claim 1 wherein said lifting lugs comprise U-shaped brackets extending through said slots and extending adjacent each side of said stiffening member toward said top edge.

3. A heat transfer element basket assembly as recited in claim 1 wherein said stiffening member further includes an additional pair of slots and lifting lugs adjacent said bottom edge of said stiffening member.

* * * * *